US009945110B2

(12) United States Patent
Chen et al.

(10) Patent No.: US 9,945,110 B2
(45) Date of Patent: Apr. 17, 2018

(54) DOUBLE-FLUSH LIGHT-TOUCH DRAIN VALVE AND DOUBLE-FLUSH CONTROL METHOD

(71) Applicant: Xiamen R&T Plumbing Technology Co.,Ltd., Haicang District, Xiamen (CN)

(72) Inventors: Haibin Chen, Xiamen (CN); Rongyu Zhang, Xiamen (CN); Zhijun Zhong, Xiamen (CN); Ruiliang Chen, Xiamen (CN)

(73) Assignee: Xiamen R&T Plumbing Technology Co., Ltd., Xiamen (CN)

( * ) Notice: Subject to any disclaimer, the term of this patent is extended or adjusted under 35 U.S.C. 154(b) by 78 days.

(21) Appl. No.: 14/945,048

(22) Filed: Nov. 18, 2015

(65) Prior Publication Data

US 2016/0153182 A1 Jun. 2, 2016

(30) Foreign Application Priority Data

Nov. 28, 2014 (CN) ..... 2014 1 0705577

(51) Int. Cl.
*E03D 1/14* (2006.01)
*E03D 1/35* (2006.01)
*E03D 5/02* (2006.01)

(52) U.S. Cl.
CPC *E03D 1/35* (2013.01); *E03D 5/02* (2013.01)

(58) Field of Classification Search
CPC ..... E03D 1/142
USPC ..... 4/324–327
See application file for complete search history.

(56) References Cited

U.S. PATENT DOCUMENTS 8,918,922 B2 * 12/2014 Kido ..... E03D 1/35 4/324
2011/0094022 A1 * 4/2011 Li ..... E03D 1/142 4/324

FOREIGN PATENT DOCUMENTS

CN 2421343 Y 2/2001
CN 203684356 U 7/2014

* cited by examiner

*Primary Examiner* — Lori Baker
(74) *Attorney, Agent, or Firm* — Young Basile Hanlon & MacFarlane, P.C.

(57) ABSTRACT

A double-flush light-touch drain valve and double-flush control method. The valve includes a base, a buoy component and a starting component, a valve body installed on the base, the base provided with an outfall, the buoy component capable of moving relatively to the base and capable of opening or closing the outfall. The starting component includes a first starting switch and a second starting switch, and the buoy component is provided with a flowing channel communicated with the inside and outside of a buoy cavity of the buoy component; and the first starting switch is operable to drive the buoy component to rise, and close the flowing channel to implement a first flush; and the second starting switch is operable to drive the buoy component to rise, and the flowing channel is opened by the starting component, to implement a second flush.

11 Claims, 16 Drawing Sheets

DOUBLE-FLUSH LIGHT-TOUCH DRAIN VALVE AND DOUBLE-FLUSH CONTROL METHOD

CROSS REFERENCE TO RELATED APPLICATION

This application claims priority to Chinese patent application no. 201410705577.2 filed Nov. 28, 2014, the contents of which is incorporated herein by reference in its entirety.

TECHNICAL FIELD

The present disclosure relates to a double-flush light-touch drain valve and a double-flush control method thereof.

BACKGROUND

Canister-type drain valves can have poor flush stability, easy to leak when used to implement a double-flush drainage function. In some instances, water for large-volume and small-volume flushing can be flushed through two vertically disposed barrels, an upper barrel being a buoy, and a bottom buoy being a buoy during no flushing and large-volume flushing, and injected with water during small-volume flushing.

SUMMARY

The present disclosure provides a double-flush light-touch drain valve. A first aspect of the present disclosure is a double-flush light-touch drain valve comprising a base (10), a buoy component and a starting component, a valve body (20) being installed on the base (10), the base (10) being provided with an outfall (11), the buoy component being capable of moving relatively to the base (10) and being capable of opening or closing the outfall (11).

A second aspect of the present disclosure is a double-flush control method of a double-flush light-touch drain: when a first starting switch is operated, a starting component drives a buoy component to raise and leave an outfall of a base for water drainage; at the same time, a flowing channel on the buoy component is closed, and a resultant force subjected by the buoy component is not influenced by the flowing channel, so as to implement a first flush; and when a second starting switch is operated, the starting component drives the buoy component to raise and leave the outfall of the base for water drainage; meanwhile, the starting component opens the flowing channel on the buoy component, and the resultant force subjected by the buoy component is influenced by the flowing channel, so as to implement a second flush.

BRIEF DESCRIPTION OF THE DRAWINGS

The present disclosure will be further described in details hereinafter with reference to the drawings and embodiments.

DETAILED DESCRIPTION

Figure 1:
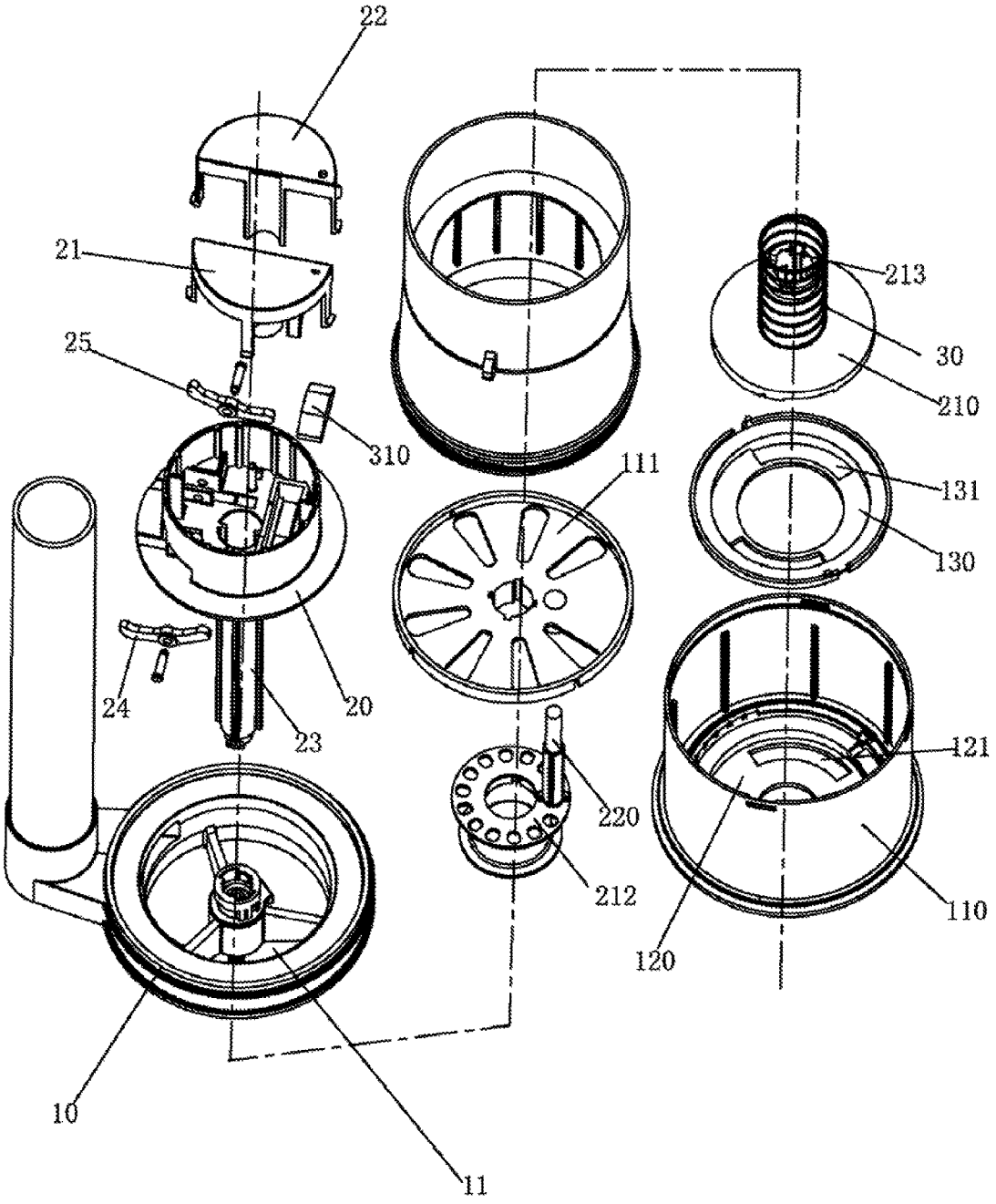
FIG. 1 shows a stereoscopic exploded schematic view of a double-flush light-touch drain valve according to a first embodiment.

According to some implementations, the flowing channel is disposed on the buoy component, and the flowing channel is communicated with the inside and outside of the buoy cavity; when the first starting switch is operated, the flowing channel is closed, so that the resultant force subjected by the buoy component is not influenced by the flowing channel so as to implement a first flush; and the second starting switch is operated, and the flowing channel is opened by the starting component, so that the resultant force subjected by the buoy component is influenced by the flowing channel so as to implement the second flush. The light-touch drain valve not only can implement double-flush drainage, but also has simple structure, strong feasibility and good drainage stability.

The buoy component includes the buoy and the base plate installed on the bottom of the buoy, the buoy cavity is formed between the base plate and the buoy, the base plate is provided with the inlet through hole capable of connecting the buoy cavity and the outfall, the inlet through hole is namely the flowing channel, and the first flush and the second flush are implemented through controlling the opening and the closing of the inlet through hole. The double-flush drainage principle is simple, the structure is simple and compact, the drainage stability is good, and the feasibility is strong.

The buoy component includes the buoy and the separating plate installed inside the buoy, the buoy cavity connected with the outfall is formed between the buoy and the separating plate, the separating plate is provided with the exhaust pipe/hole capable of being connected with the buoy cavity and external air, the exhaust pipe/hole is namely the flowing channel, and the first flush and the second flush are implemented through controlling the opening and the closing of the exhaust pipe/hole. The double-flush drainage principle is simple, the structure is simple and compact, the drainage stability is good, and the feasibility is strong.

The starting component is provided with the switching part and the controlling part in driving fit with each other, the switching part is in driving fit with the first and the second starting switches, the controlling part is fit with the flowing channel, and controlling of the opening and the closing of the flowing channel is implemented by the first and the second starting switches through the switching part and the controlling part. The control structure is simple, and the reliability is strong.

The size of the flowing channel is regulated through setting the regulating sheet, the regulating sleeve or the regulating stem, so that the second flush can be regulated freely, which facilitates different user requirements and is convenient to regulate. The structure is simple, and the function is reliable.

FIGS. 1-5 show a first embodiment of a double-flush light-touch drain valve, wherein the double-flush light-touch drain valve includes a base 10, a starting component and a buoy component.

The base 10 is provided with an outfall 11, a valve body 20 is installed and connected to the base 10, and the buoy component is capable of moving relatively to the base 10 and is capable of opening or closing the outfall 11.

In the embodiment, the buoy component includes a hollow buoy 110 extending along a longitudinal axis, the hollow buoy 110 is sleeved and fit with the valve body 20, and moves in a reciprocating manner along the vertical direction of the valve body 20.

In the embodiment, the valve body 20 is provided with a guide rod 23 for guiding the buoy component, the guide rod 23 is fixedly installed the base 10, the hollow buoy 110 is sleeved outside the guide rod 23 and vertically moves in a reciprocating manner along the guide rod 23. The valve body 20 is further provided with a first lifting rod 24 and a second lifting rod 25.

The starting component includes a first starting switch and a second starting switch, the first lifting rod 24 is in drive connection with the first starting switch and the buoy component, and the second lifting rod 25 is in drive connection with the second starting switch and the buoy component. In the embodiment, the first starting switch is a first key 21, the second starting switch is a second key 22, the first key 21 and the second key 22 are movably installed on the valve body 20. Or, in the embodiment, only one lifting rod is arranged, and both the first key 21 and the second key 22 are in drive connection with the lifting rod.

In the embodiment, the starting component further includes a switching part and a controlling part, the switching part is in driving fit with the controlling part, and the switching part is in drive connection with the first starting switch or the second starting switch.

In the embodiment, the controlling part is installed inside the buoy 110, the controlling part includes a controlling plate 210, and the top end of the controlling part is provided with a pressed block 220 in an upwards extruding manner.

In the embodiment, the inside of the buoy 110 is also provided with a guide sleeve 111, and the guide sleeve 111 is configured to guide the motion of the controlling part.

In the embodiment, the controlling part further includes a top plate 212 arranged in the buoy 110, the top plate 212 and the controlling plate 210 are fixedly connected through a joint pin 213 traversing the base plate 120, the pressed block 220 is fixedly installed on the top end surface of the top plate 212, and the pressed block 220 traverses a guide hole on the guide sleeve 111.

In the embodiment, the switching part is a sliding block 310, the sliding block 310 is movably installed on the valve body 20 and is in drive connection with the first key 21 and the second key 22, the sliding block 310 is downwards provided with a pressing block 311, the first key 21 is pressed to drive the sliding block 310 to move so that the pressing block 311 is in staggering fit with the pressed block 220, and the second key 22 is pressed to drive the sliding block 310 to move so that the pressing block 311 is in pressing fit with the pressed block 220. In the embodiment, the inside of the valve body is also provided with a slide groove, the sliding block 310 is movably installed inside the slide groove, the sliding 310 is provided with two slopes which are respectively fit with slopes on the first key 21 and the second key 22 to implement drive connection.

As needed, the sliding block 310 may be replaced by a rocking block, and the rocking block is installed on the valve body 20 in a rocking manner. The buoy component is movably installed on the valve body 20 and is in drive connection with the starting component, the buoy component is provided with a flowing channel, and the flowing channel is communicated with the inside and outside of a buoy cavity 112 of the buoy component.

The first starting switch is operated to drive the buoy component to rise, and the flowing channel is closed, so that a resultant force subjected by the buoy component is not influenced by the flowing channel so as to implement a first flush; and the second starting switch is operated to drive the buoy component to rise, and the flowing channel is opened by the starting component, so that the resultant force subjected by the buoy component is influenced by the flowing channel so as to implement a second flush.

The controlling part is fit with the flowing channel, the first starting switch or second starting switch is operated, and the controlling part is driven by the switching part so as to control the opening and the closing of the flowing channel.

In the embodiment, the buoy component includes a buoy 110 and a base plate 120 installed on the bottom of the buoy 110, the buoy cavity 112 is formed between the base plate 120 and the buoy 110, the base plate 120 is provided with an inlet through hole 121 capable of connecting the buoy cavity 112 and the outfall 11, and the inlet through hole 121 is namely the flowing channel; when the first starting switch is operated, water cannot enter the inside of the buoy 110 from the inlet through hole 121 so that the resultant force subjected by the buoy component is not influenced by the inlet through hole 121 so as to implement the first flush; and when the second starting switch is operated, water enters the inside of the buoy 110 from the inlet through hole 121 so that the resultant force subjected by the buoy component is influenced by the inlet through hole 121 so as to implement the second flush.

In the embodiment, when the switching part and the controlling part are in staggering fit, the inlet through hole 121 is closed, and when the switching part and the controlling part are in pressing fit, the inlet through hole 121 is opened.

In the embodiment, when the switching part and the controlling part are in staggering fit, the controlling plate 210 is attached to the base plate 120 so as to close the inlet through hole 121, and when the switching part and the controlling part are in pressing fit, the controlling plate 210 is detached from the base plate 120 so as to open the inlet through hole 121.

In the embodiment, the buoy component further includes an auxiliary buoy 40 which is installed above the buoy 110 through clamping, wherein the auxiliary buoy 40 and the buoy 110 are movably sleeved outside the valve body together.

In the embodiment, the drain valve further includes a regulating sheet 130 capably of rotating relative to the base plate 120, wherein the regulating sheet 130 is provided with a first regulating hole 131 for regulating the size of the inlet through hole 121, which implements to regulate the size of the inlet through hole 121 by making the first regulating hole 131 be aligned with or staggered from the inlet through hole 121; or, the size of the inlet through hole 121 may also be regulated by partially or entirely covering the inlet through hole 121 through the regulating sheet 130. The second flush can be regulated freely by regulating the size of the inlet through hole 121 through the regulating sheet 130, which facilitates different user requirements, and is convenient to regulate. The structure is simple, and the function is reliable.

In the embodiment, the drain valve further includes an elastic restoring part 30 for restoring the controlling part, which leans against between the controlling plate 210 and the base plate 120 of the buoy component, and is sleeved outside the joint pin 213; when the buoy 110 drops to re-close the outfall 11, the controlling plate 210 is restored and re-attached to the base plate 120 under the action of the elastic restoring part 30.

A working principle of the drain valve is as follows.

Figure 2:
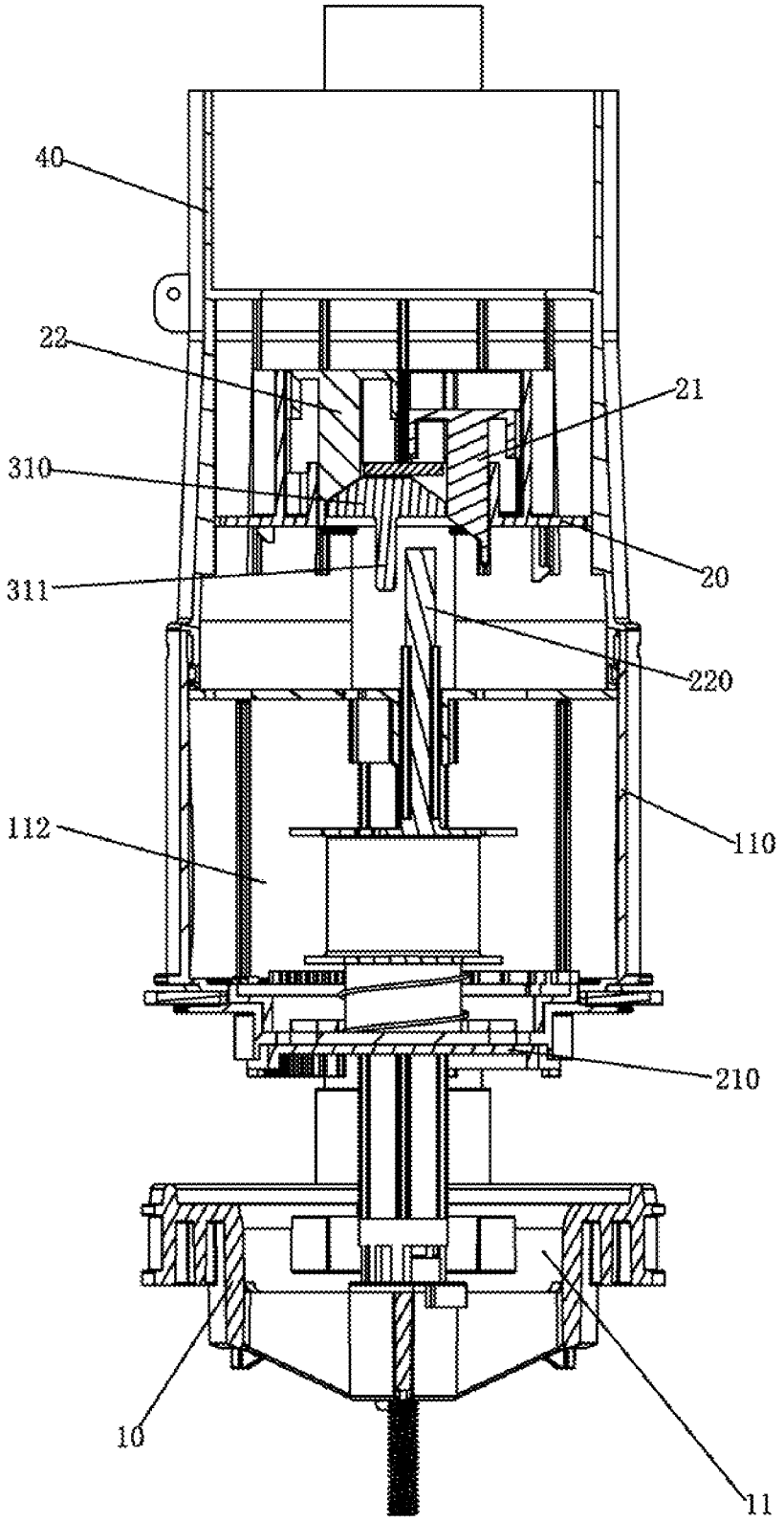
FIG. 2 shows a first sectional schematic view of implementing the first flush of the double-flush light-touch drain valve according to the first embodiment.
Figure 3:
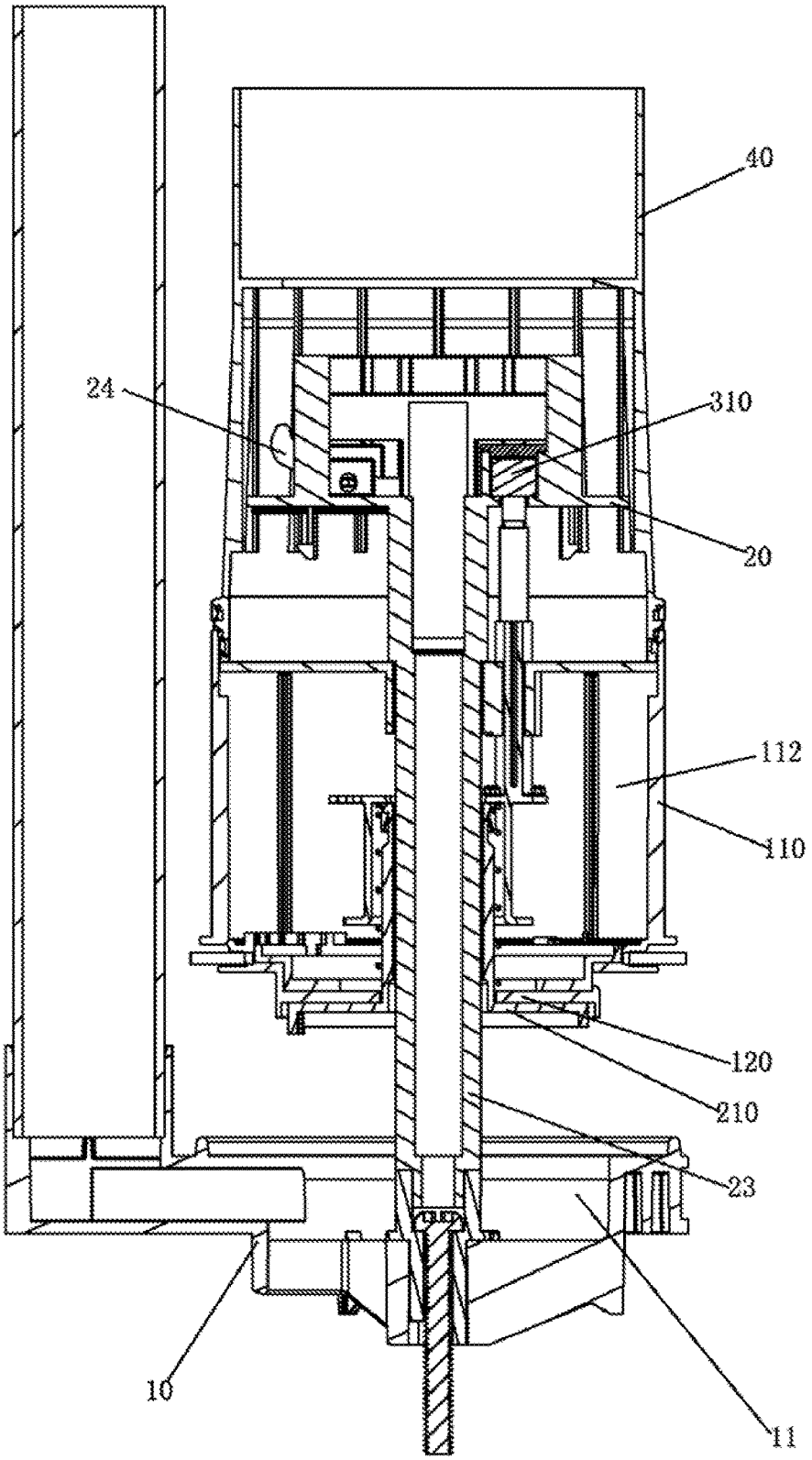
FIG. 3 shows a second sectional schematic view of implementing the first flush of the double-flush light-touch drain valve according to the first embodiment.

As shown in FIGS. 2 and 3, the first key 21 is pressed, the first lifting rod 24 drives the buoy 110 and the controlling part to move upwards at the same time; meanwhile, the first key 21 pushes the sliding block 310 to move, so that the pressing block 311 is staggered from the pressed block 220 so as to give way for the controlling part to continuously move upwards with the buoy 110, the controlling plate 210 and the base plate 120 keep a primary jointed state; at this moment, the controlling plate 210 closes the inlet through hole 121, and water cannot enter the inside of the buoy 110, so that the buoy 110 rises up for a longer time, and drops slowly; when the weight of the buoy 110 is greater than the buoyancy subjected thereof, the buoy 110 downwards falls off to seal water, and the flush at this moment is the first flush, i.e., big-volume flush.

Figure 4:
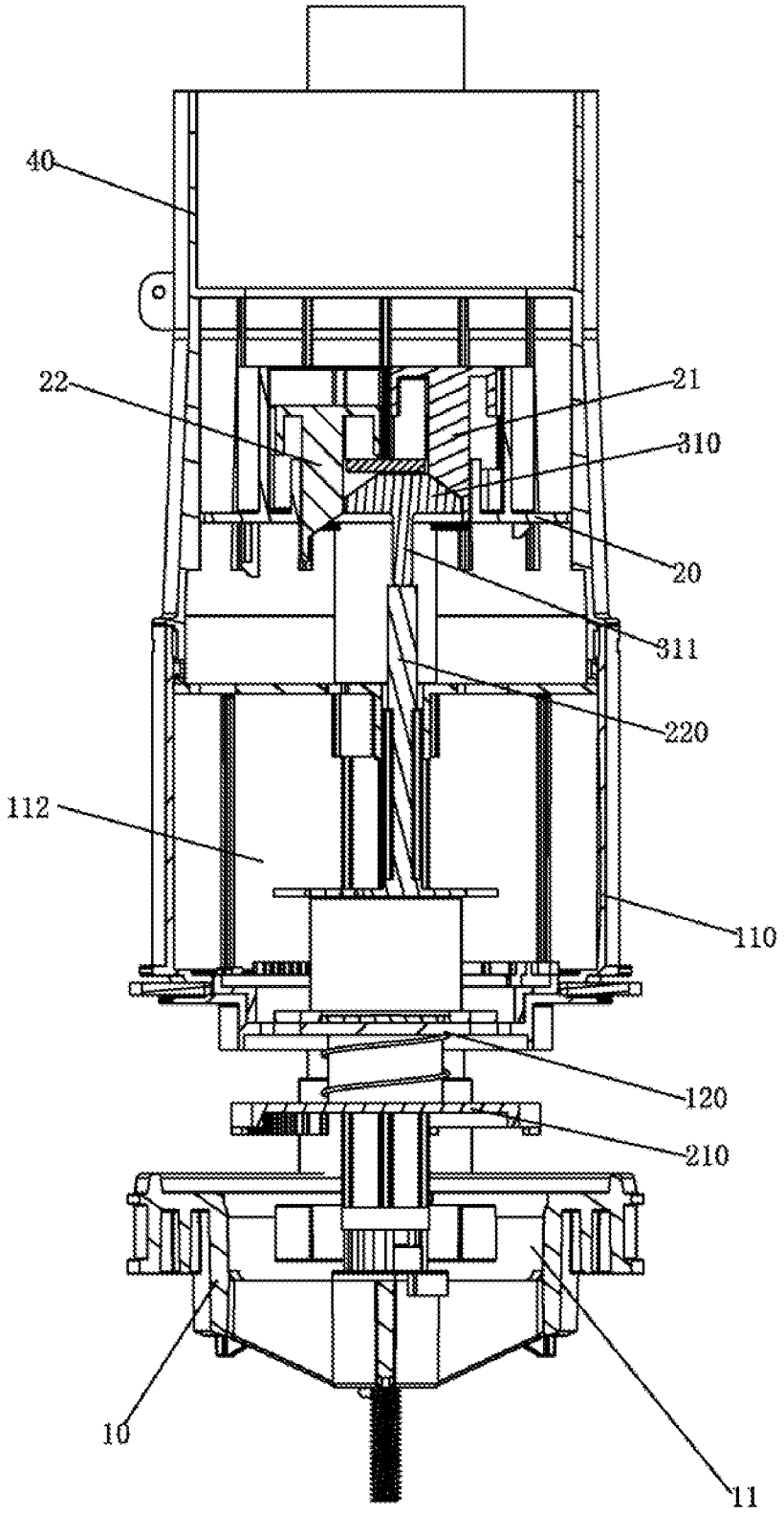
FIG. 4 shows a first sectional schematic view of implementing the second flush of the double-flush light-touch drain valve according to the first embodiment.
Figure 5:
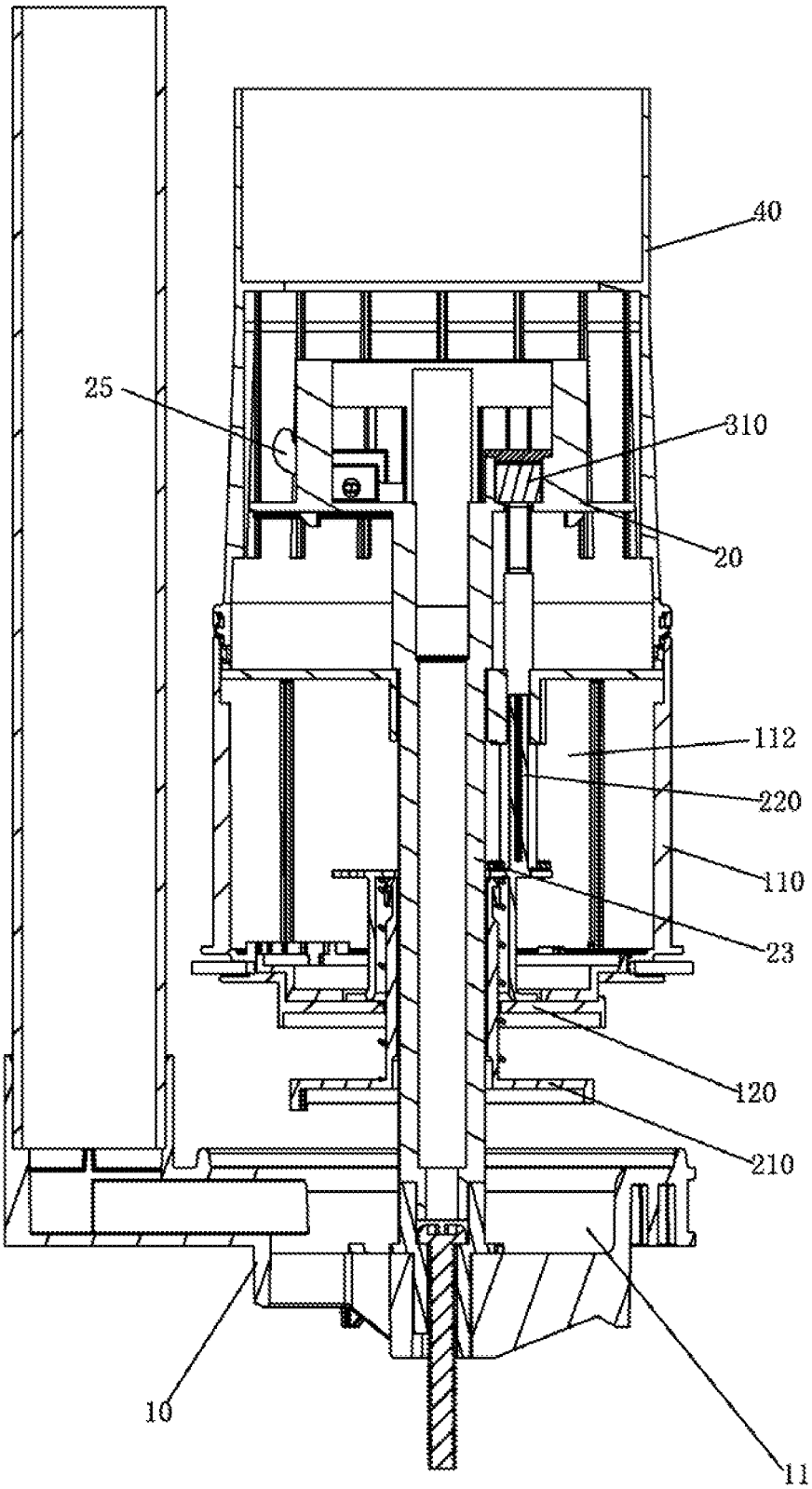
FIG. 5 shows a second sectional schematic view of implementing the second flush of the double-flush light-touch drain valve according to the first embodiment.
Figure 6:
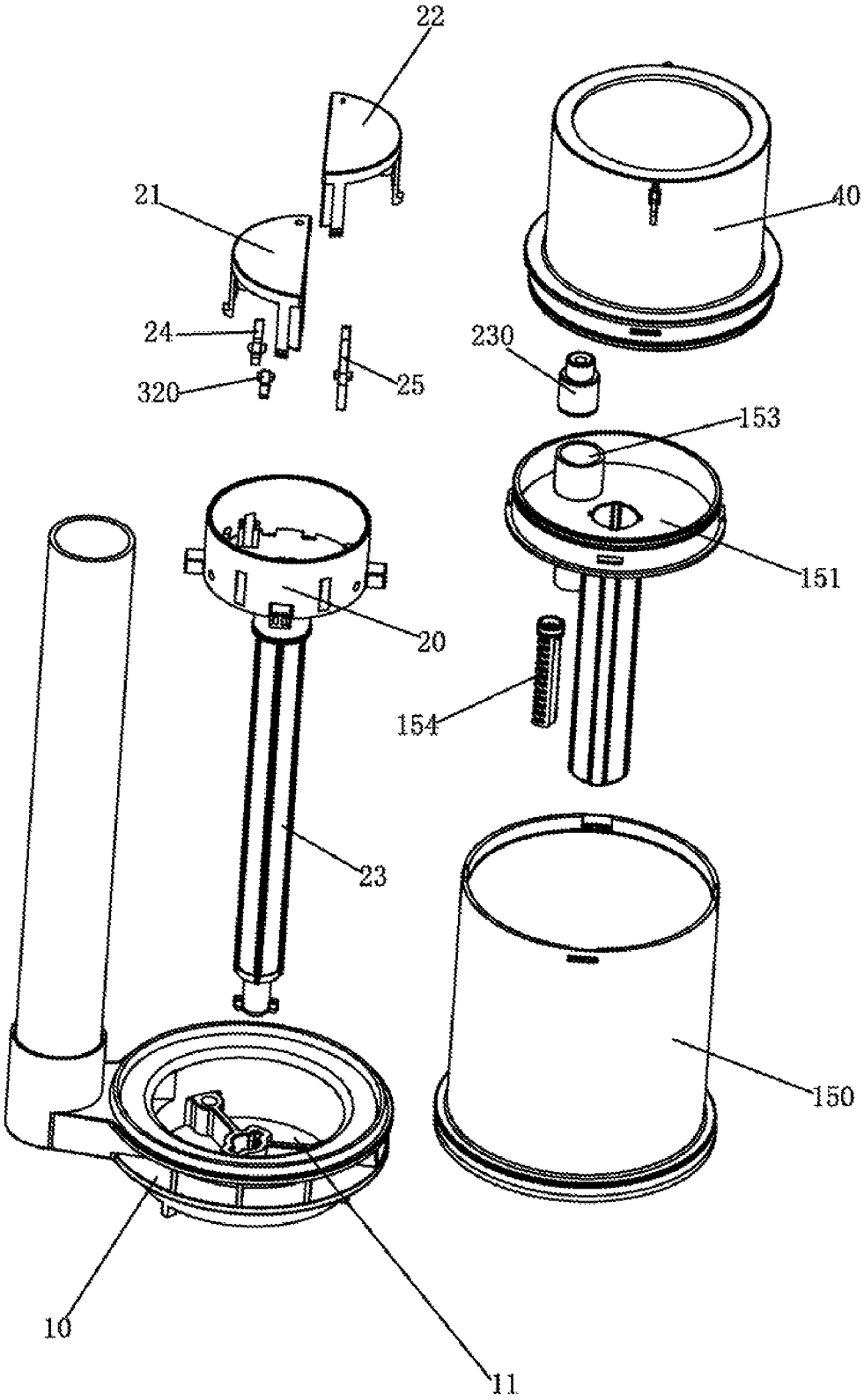
FIG. 6 shows a stereoscopic exploded schematic view of a double-flush light-touch drain valve according to a second embodiment.

As shown in FIGS. 4 and 5, the second key 22 is pressed, the second lifting rod 25 drives the buoy 110 and the controlling part to move upwards at the same time; meanwhile, the second key 22 pushes the sliding block 310 to move, so that the pressing block 311 is in pressing fit with the pressed block 220 so as to restrict the controlling part to continuously move upwards with the buoy 110, so that the controlling plate 210 is detached from the base plate 120; at this moment, the controlling plate 210 opens the inlet through hole 121, and water enters the inside of the buoy 110 through the inlet through hole 121, so that the weight of the buoy 110 is increased; therefore, the buoy 110 rises up for a shorter time, and drops fast when the weight of the buoy 110 is greater than the buoyancy subjected thereof, the buoy 110 downwards falls off to seal water, and the flush at this moment is the second flush, i.e., small-volume flush.

FIGS. 6-10 show a second embodiment of the double-flush light-touch drain valve. Like numerals refer to like elements in FIGS. 1-5, which will not be repeated here. In the embodiment, the buoy component includes a buoy 150 and a separating plate 151 installed inside the buoy 150, the buoy cavity 152 connected with the outfall 11 is formed between the buoy 150 and the separating plate 151, the separating plate 151 is provided with an exhaust pipe 153 capable of being connected with the buoy cavity 152 and external air, and the exhaust pipe 153 is namely the flowing channel; when the first starting switch is operated, the exhaust pipe 153 is closed, and water enters the buoy cavity 152 while the air in the buoy cavity 152 cannot be exhausted from the exhaust pipe 153, so that the resultant force subjected by the buoy component is not influenced by the exhaust pipe 153 so as to implement the first flush; and when the second starting switch is operated, the exhaust pipe 153 is opened, and the water enters the buoy cavity 152 to exhaust the air in the buoy cavity 152 out from the exhaust pipe 153, so that the resultant force subjected by the buoy component is influenced by the exhaust pipe 153 so as to implement the second flush.

In the embodiment, the exhaust pipe 153 is closed when the switching part and the controlling part are in staggering fit, and the exhaust pipe 153 is opened when the switching part and the controlling part are in pressing fit.

In the embodiment, the controlling part is a one-way valve 230 installed inside the exhaust pipe 153, the one-way valve 230 closes the exhaust pipe 153 when the switching part and the controlling part are in staggering fit, and the one-way valve 230 opens the exhaust pipe 153 when the switching part and the controlling part are in pressing fit.

In the embodiment, the switching part is a rocking beam 320 rotatably installed on the valve body 20, the rocking beam 320 is provided with a first rocking block 321 and a second rocking block 322, the first rocking block 321 is in driving fit with the first key 21, the first key 21 is pressed to drive the rocking beam 320 to rock, so that the second rocking block 322 is staggered from the one-way valve 230; the second key 22 is pressed, and the rocking beam 320 keep still, so that the second rocking block 322 is in pressing fit with the one-way valve 230; or, the switching part may be designed as a sliding block installed on the valve body 20 in a sliding manner as needed, the first key 21 is pressed to drive the sliding block to slide so that the sliding block is staggered from the one-way valve 230; the second key 22 is pressed, and the sliding block keeps still, so that the sliding block is in pressing fit with the one-way valve 230.

In the embodiment, the exhaust pipe 153 is fixedly installed on the separating plate 151, and a regulating sleeve 154 is additionally arranged, the regulating sleeve 154 is movably sleeved at the lower portion of the exhaust pipe 153 so as to regulate the height of the bottom end of the regulating sleeve 154 in the buoy cavity 152. Or, the exhaust pipe 153 may be directly designed to be vertically and movably installed on the separating plate 151 as needed, so as to regulate the height of the bottom port of the exhaust pipe 153 in the buoy cavity 152. The second flush can be regulated freely by regulating the height of the bottom port of the exhaust pipe 153 or the bottom port of the regulating sleeve 154 in the buoy cavity 152, which facilitates different user requirements and is convenient to regulate. The structure is simple, and the function is reliable.

A working principle of the drain valve is as follows.

Figure 7:
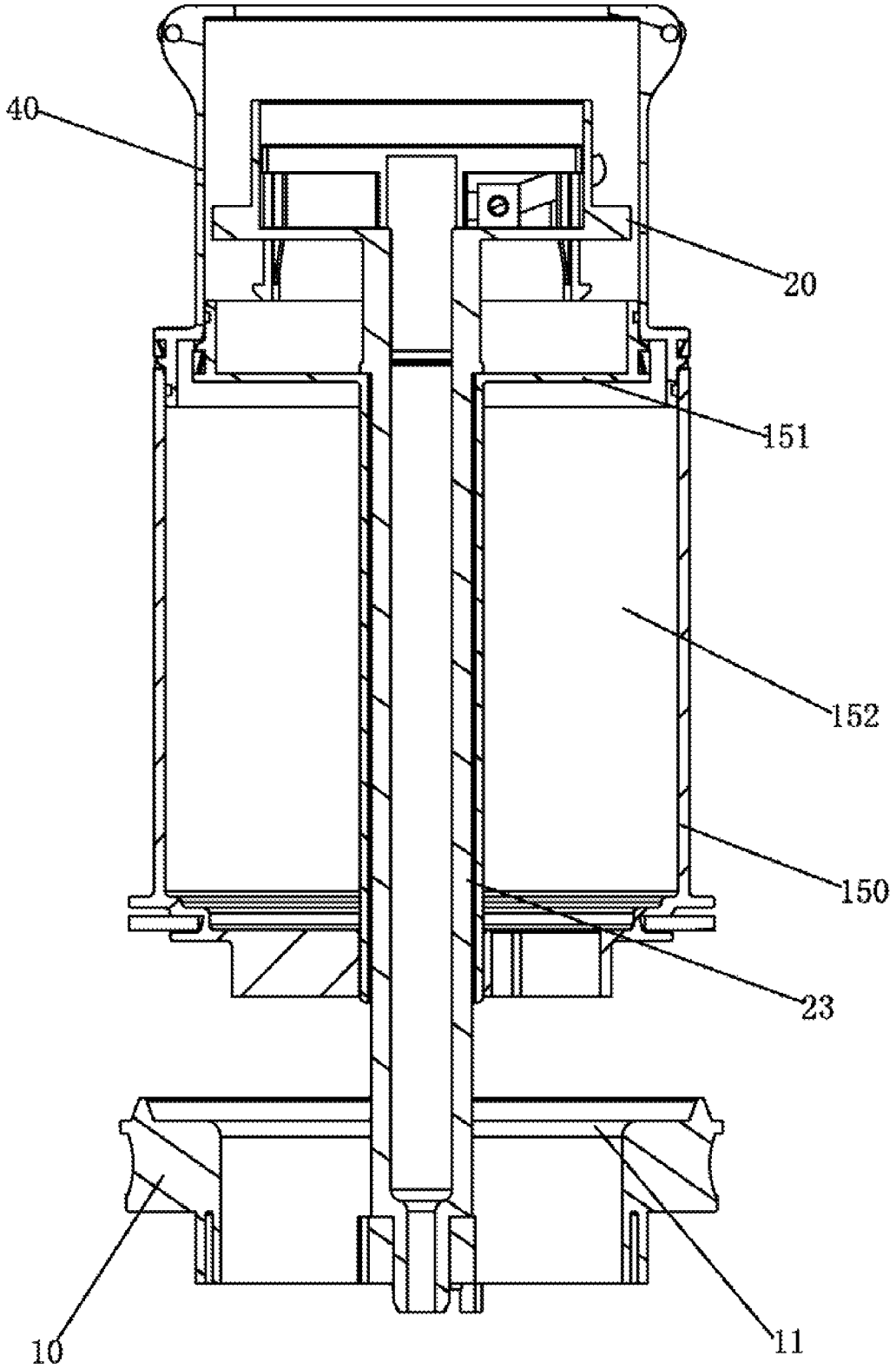
FIG. 7 shows a first sectional schematic view of implementing the second flush of the double-flush light-touch drain valve according to the second embodiment.
Figure 8:
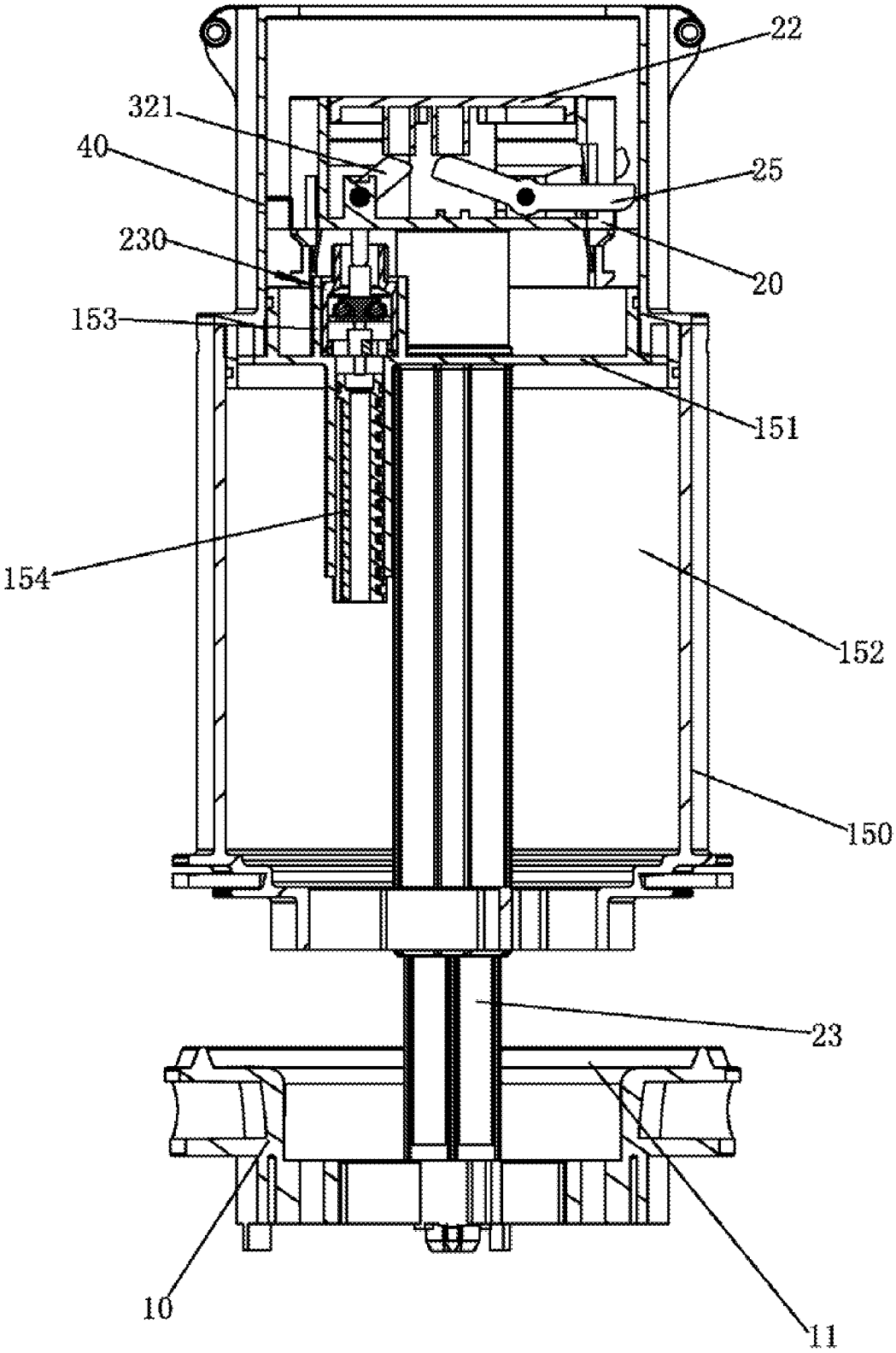
FIG. 8 shows a second sectional schematic view of implementing the second flush of the double-flush light-touch drain valve according to the second embodiment.

As shown in FIGS. 7 and 8, the second key 22 is pressed, the second lifting rod 25 drives the buoy 150 and the controlling part to move upwards at the same time; meanwhile, the second key 22 does not drive the rocking beam 320 to rock, so that the rocking beam 320 keeps a primary state, the second rocking block 322 is in pressing fit with the one-way valve 230, the one-way valve 230 opens the exhaust pipe 153, water enters the buoy cavity 152 so as to exhaust the air in the buoy cavity 152 out from the exhaust pipe 153, the buoyancy of the buoy 150 is smaller, and the buoy drops quickly with the drop of water level; therefore, the second flush implemented at this moment is small-volume flush.

Figure 9:
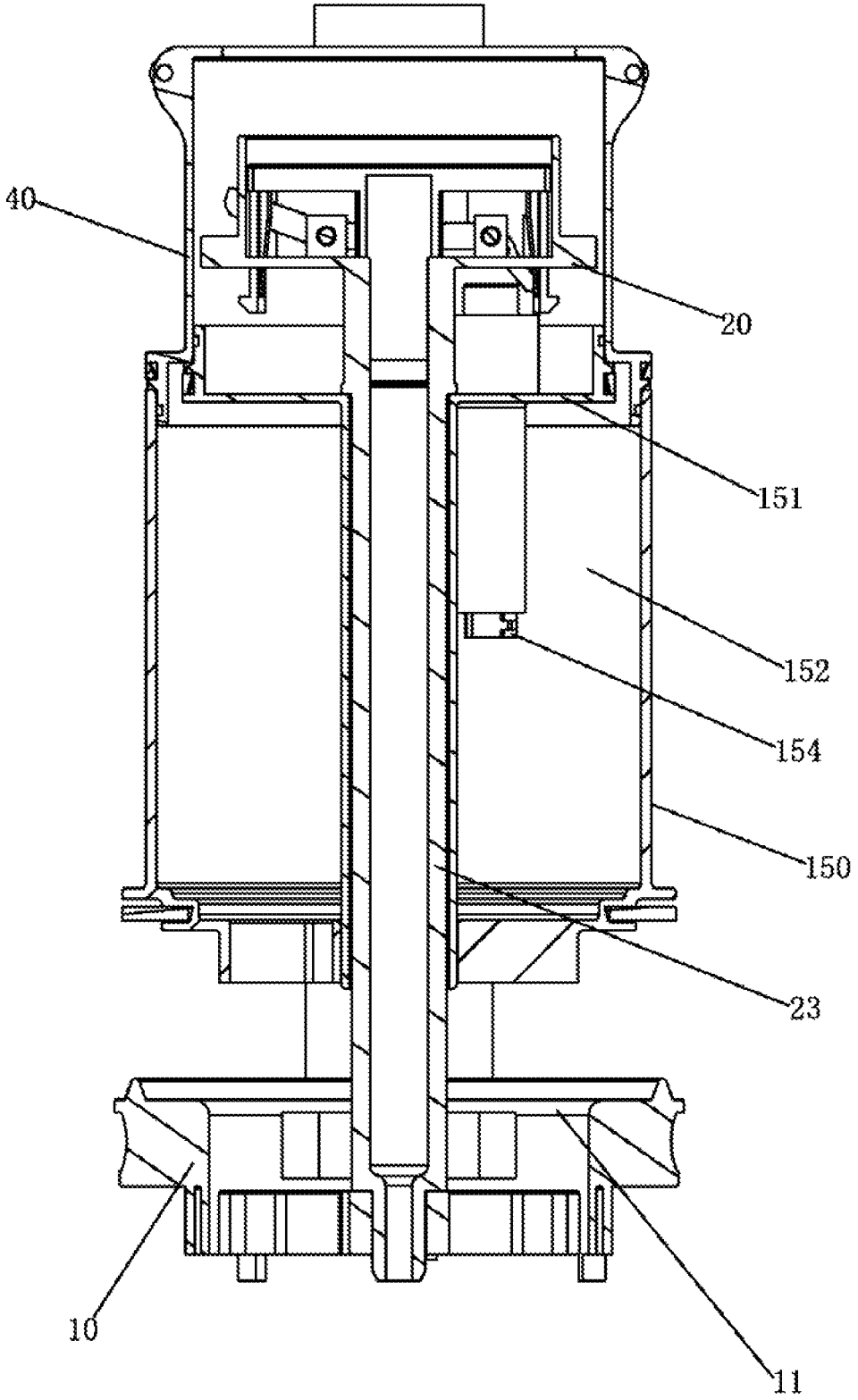
FIG. 9 shows a first sectional schematic view of implementing the first flush of the double-flush light-touch drain valve according to the second embodiment.
Figure 10:
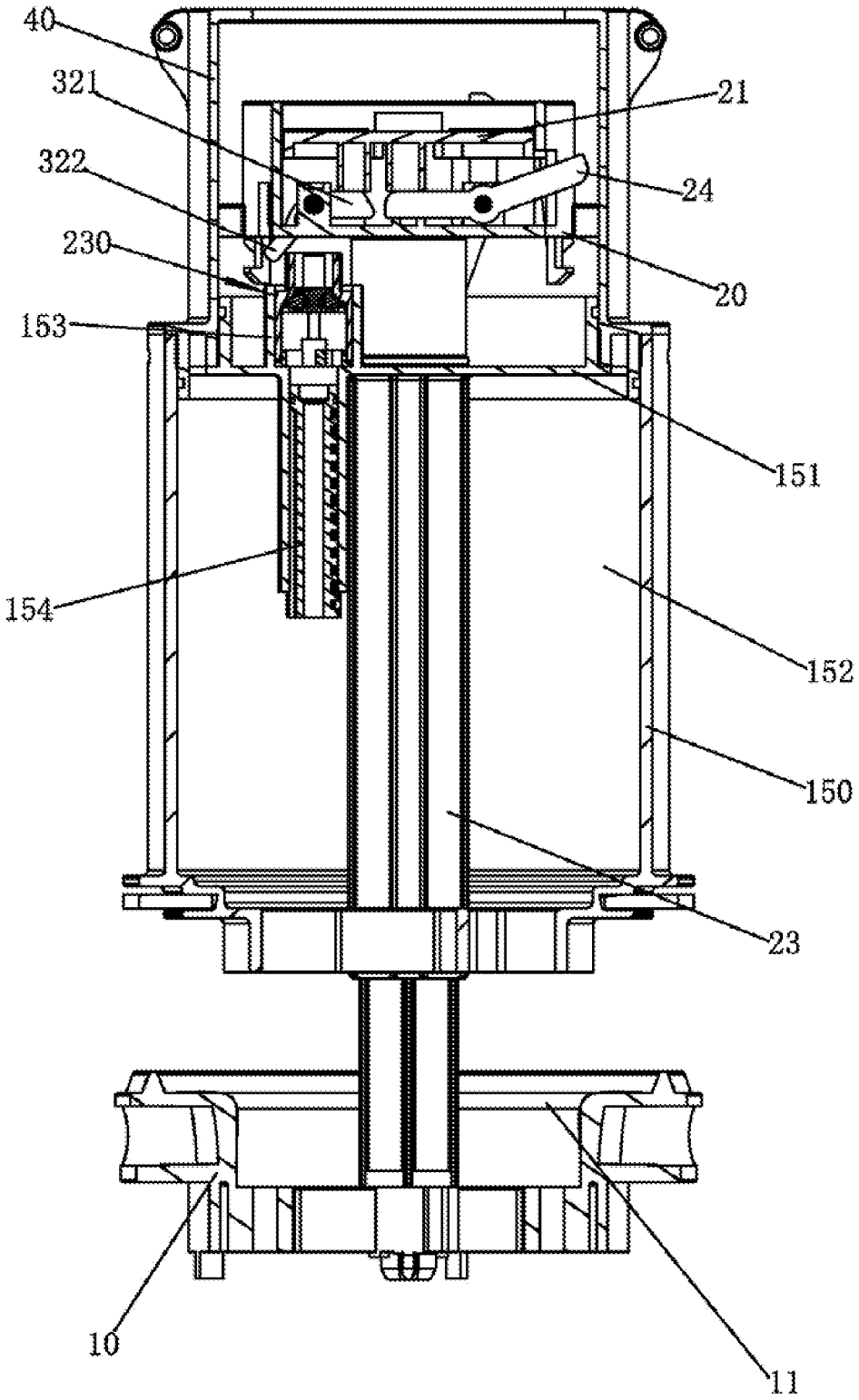
FIG. 10 shows a second sectional schematic view of implementing the first flush of the double-flush light-touch drain valve according to the second embodiment.
Figure 11:
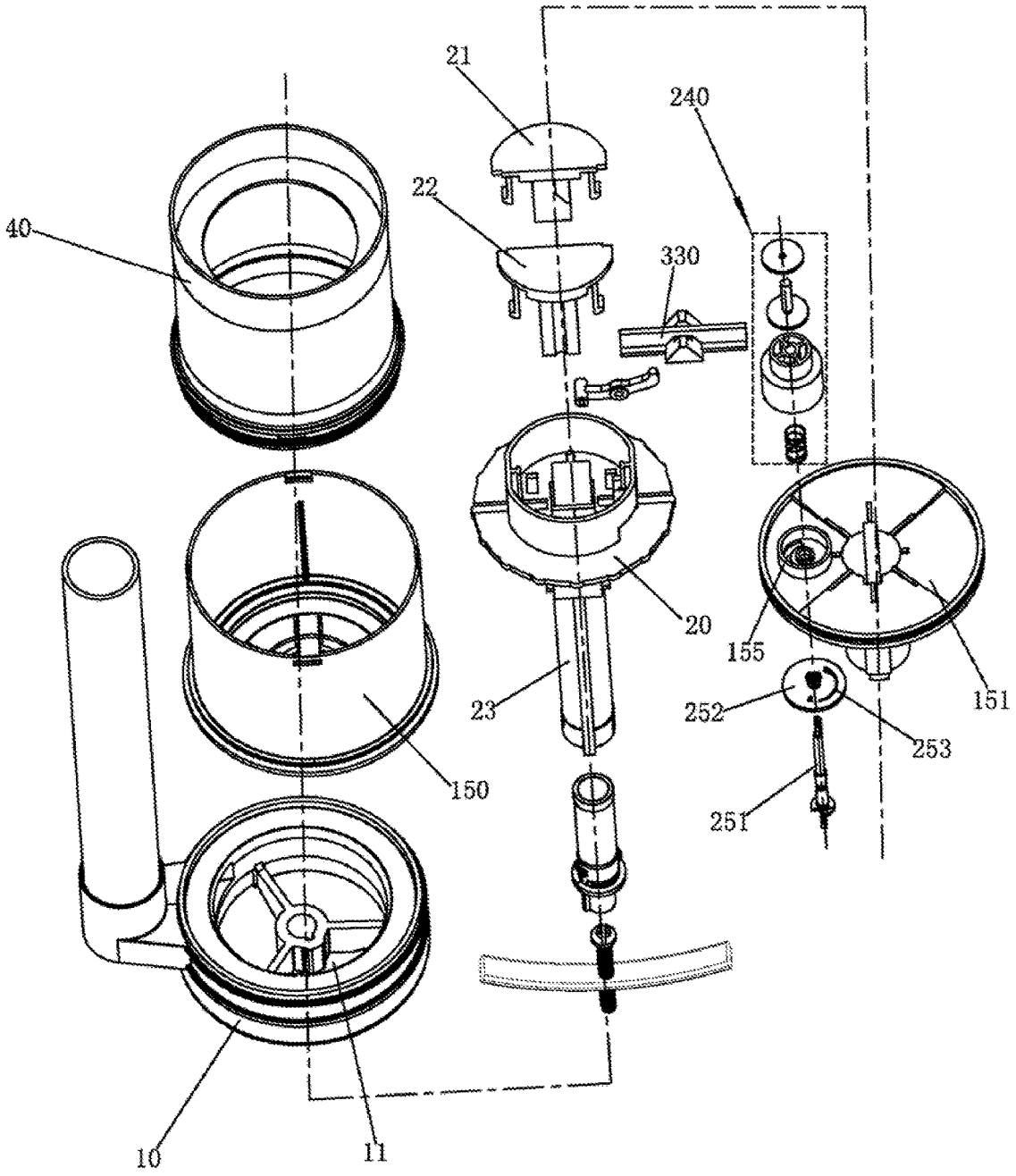
FIG. 11 shows a stereoscopic exploded schematic view of a double-flush light-touch drain valve according to a third embodiment.

As shown in FIGS. 9 and 10, the first key 21 is pressed, the first lifting rod 24 drives the buoy 150 and the controlling part to move upwards at the same time; meanwhile, the first key 21 drives the rocking beam 320 to rock, so that the second rocking block 322 is staggered from the one-way valve 230 to give way, the one-way valve 230 closes the exhaust pipe 153, water enters the buoy cavity 152, while the air in the buoy cavity 152 cannot be exhausted out from the exhaust pipe 153; therefore, the buoyancy of the buoy 150 is larger, and the buoy drops slowly with the drop of water level; therefore, the first flush implemented at this moment is big-volume flush.

FIG. 11-15 show a third embodiment of the double-flush light-touch drain valve. Like reference numerals indicate like elements in FIGS. 1-10.

In the embodiment, the separating plate 151 is provided with an exhaust hole 155 capable of being connected with the buoy cavity 152 and external air, and the exhaust hole 155 is namely the flowing channel, the controlling part is the one-way valve 240 fit with the exhaust hole 155, and the one-way valve 240 can open or close the exhaust hole 155. The one-way valve 240 closes the exhaust hole 155 when the switching part and the one-way valve 240 are in staggering fit, and the one-way valve 240 opens the exhaust hole 155 when the switching part and the one-way valve 240 are in pressing fit.

In the embodiment, the switching part is a sliding block 330, the sliding block 330 is installed on the valve body 20 in a horizontal sliding manner, and is in drive connection with the first key 21 and the second key 22, the first key 21 is pressed to drive the sliding block 330 to slide so that the sliding block 330 is in staggering fit with the one-way valve 240, and the second key 22 is pressed to drive the sliding block 330 to slide so that the sliding block 330 is in pressing fit with the one-way valve 240. Or, the switching part may also be designed as a rocking block, the rocking block is movably installed on the valve body 20 and is in drive connection with the first key 21 and the second key 22, the first key 21 is pressed to drive the rocking block to rock so that the rocking block is in staggering fit with the controlling part, and the second key 22 is pressed to drive the rocking block to rock so that the rocking block is in pressing fit with the controlling part.

In the embodiment, the drain valve further includes a regulating stem 251 movably installed on the buoy component, wherein the top end of the regulating stem 251 is provided with a regulating portion 252 fit with the exhaust hole 155 and the regulating stem 251 is rotated so that the regulating portion 252 partially or entirely shades the exhaust hole 155 so as to regulate the size of the exhaust hole 155, and the bottom end of the regulating stem downwards extends out of the bottom of the buoy 150 and is provided with a manual regulating knob to facilitate regulating; or, the regulating portion 252 is provided with a second regulating hole 253, and the regulating stem 251 is rotated so that the second regulating hole 253 is aligned with or staggered from the exhaust hole 155 so as to regulate the size of the exhaust hole 155. The second flush can be regulated freely by regulating the size of the exhaust hole 155 through the regulating stem 251, which facilitates different user requirements, and is convenient to regulate. The structure is simple, and the function is reliable.

A working principle of the drain valve is as follows.

Figure 12:
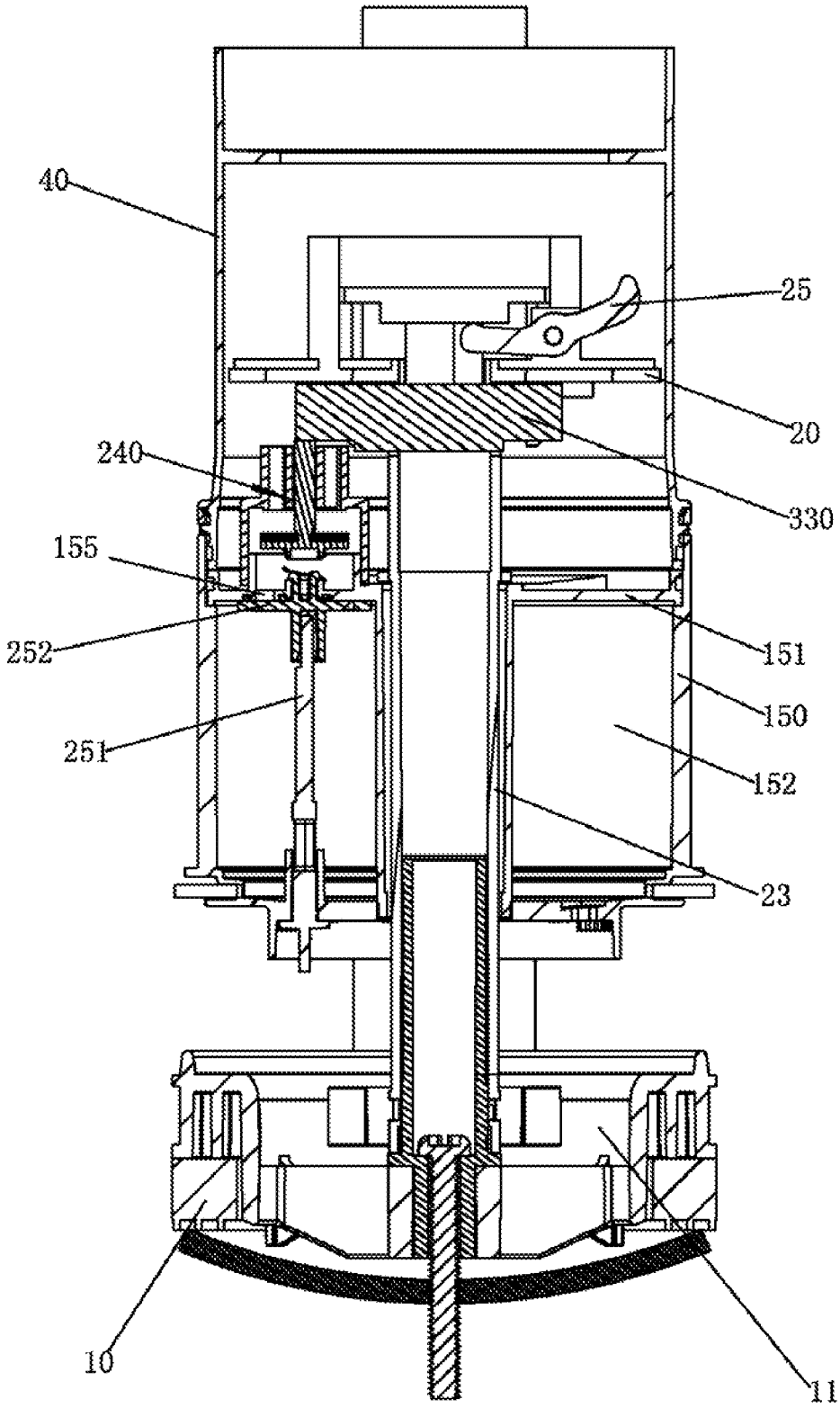
FIG. 12 shows a first sectional schematic view of implementing the second flush of the double-flush light-touch drain valve according to the third embodiment.
Figure 13:
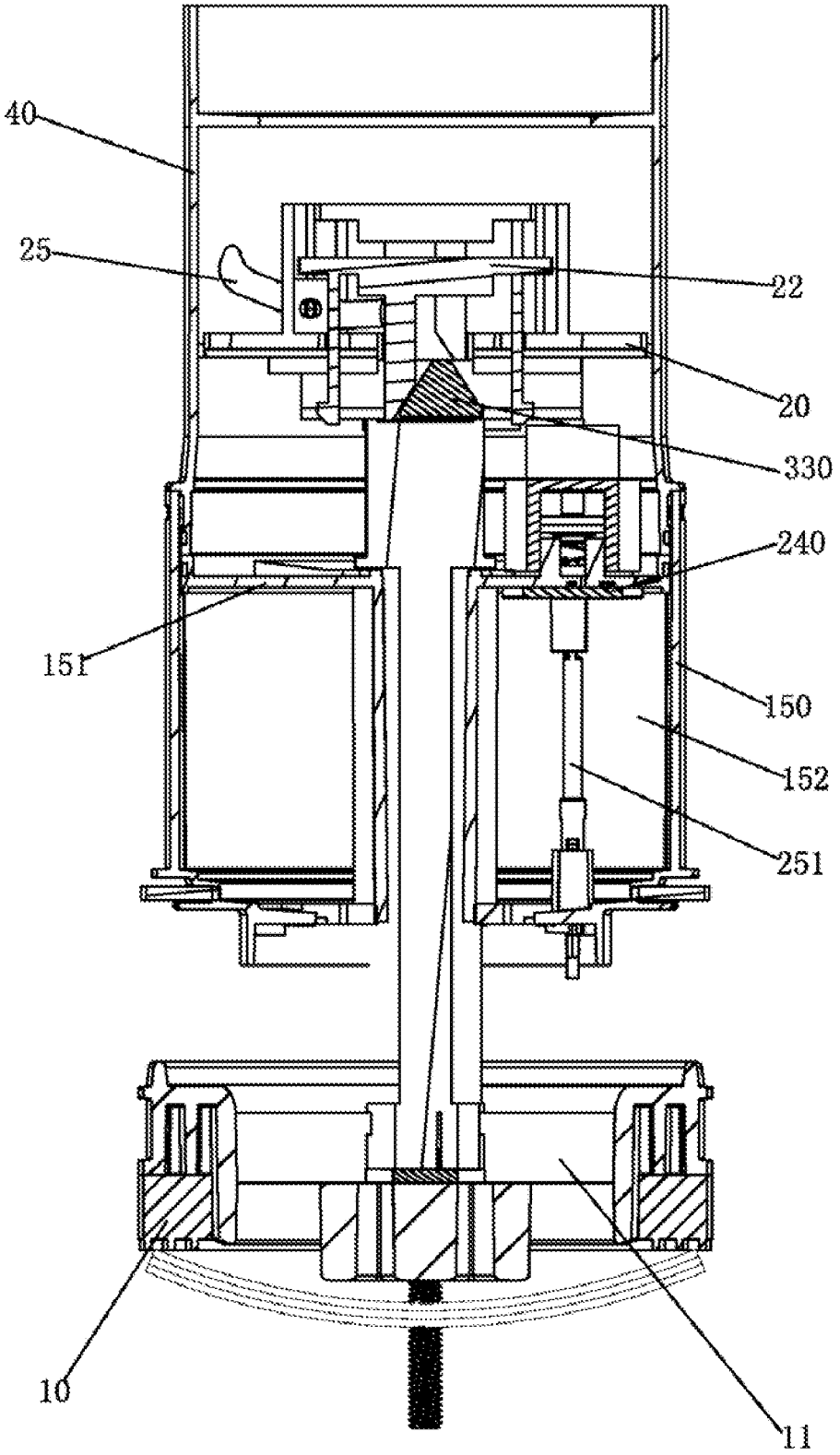
FIG. 13 shows a second sectional schematic view of implementing the second flush of the double-flush light-touch drain valve according to the third embodiment.

As shown in FIG. 12 and FIG. 13, the second key 22 is pressed, the second lifting rod 25 drives the buoy 150 and the controlling part to rise up at the same time; meanwhile, the second key 22 drives the sliding block 330 to slide towards the one-way valve 240, so that the sliding block 330 is in pressing fit with the one-way valve 240, the one-way valve 240 opens the exhaust hole 155, water enters the buoy cavity 152 so as to exhaust the air in the buoy cavity 152 out from the exhaust hole 155, the buoyancy of the buoy 150 is smaller, and the buoy 150 drops quickly with the drop of water level; therefore, the second flush implemented at this moment is small-volume flush.

Figure 14:
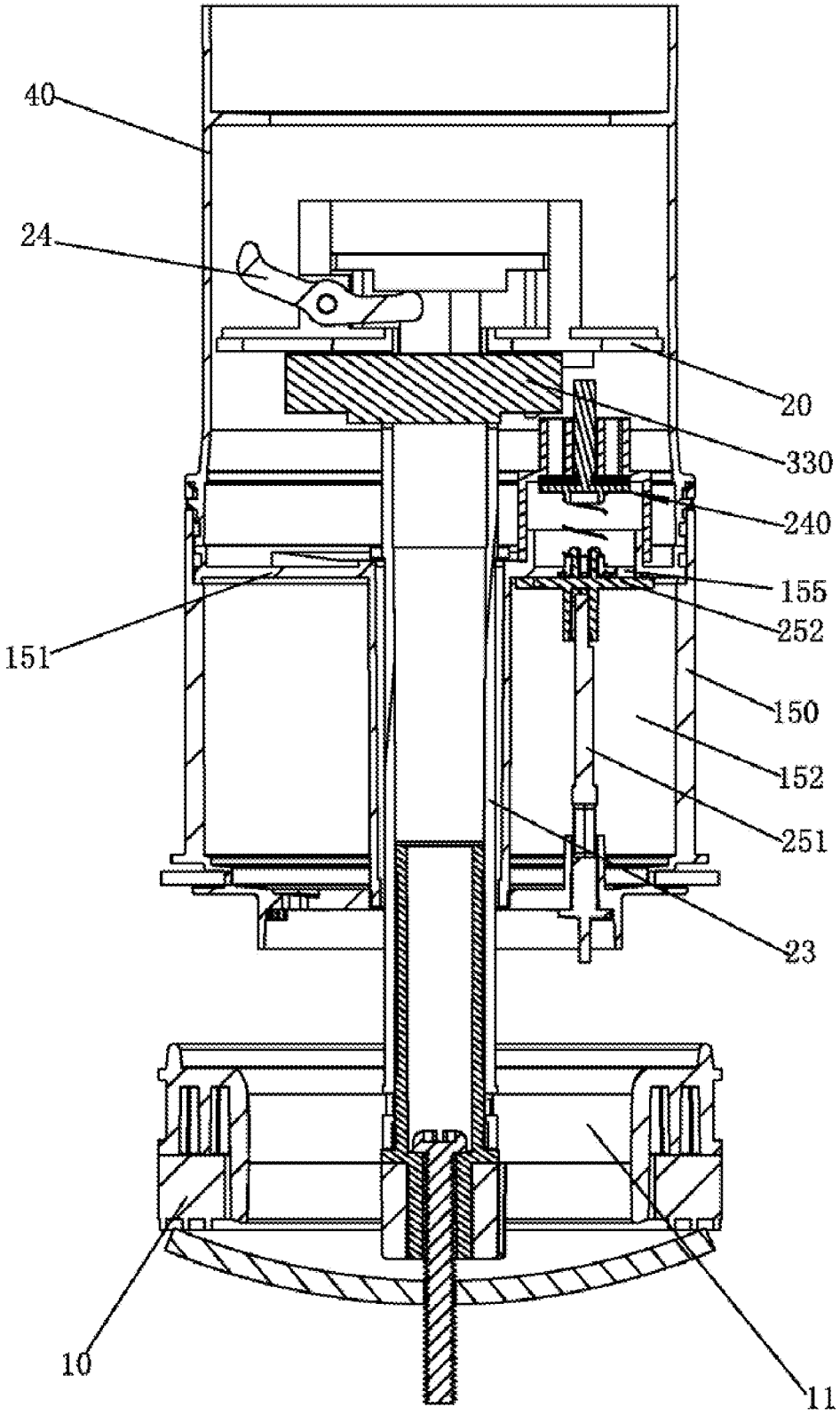
FIG. 14 shows a first sectional schematic view of implementing first flush of the double-flush light-touch drain valve according to the third embodiment.
Figure 15:
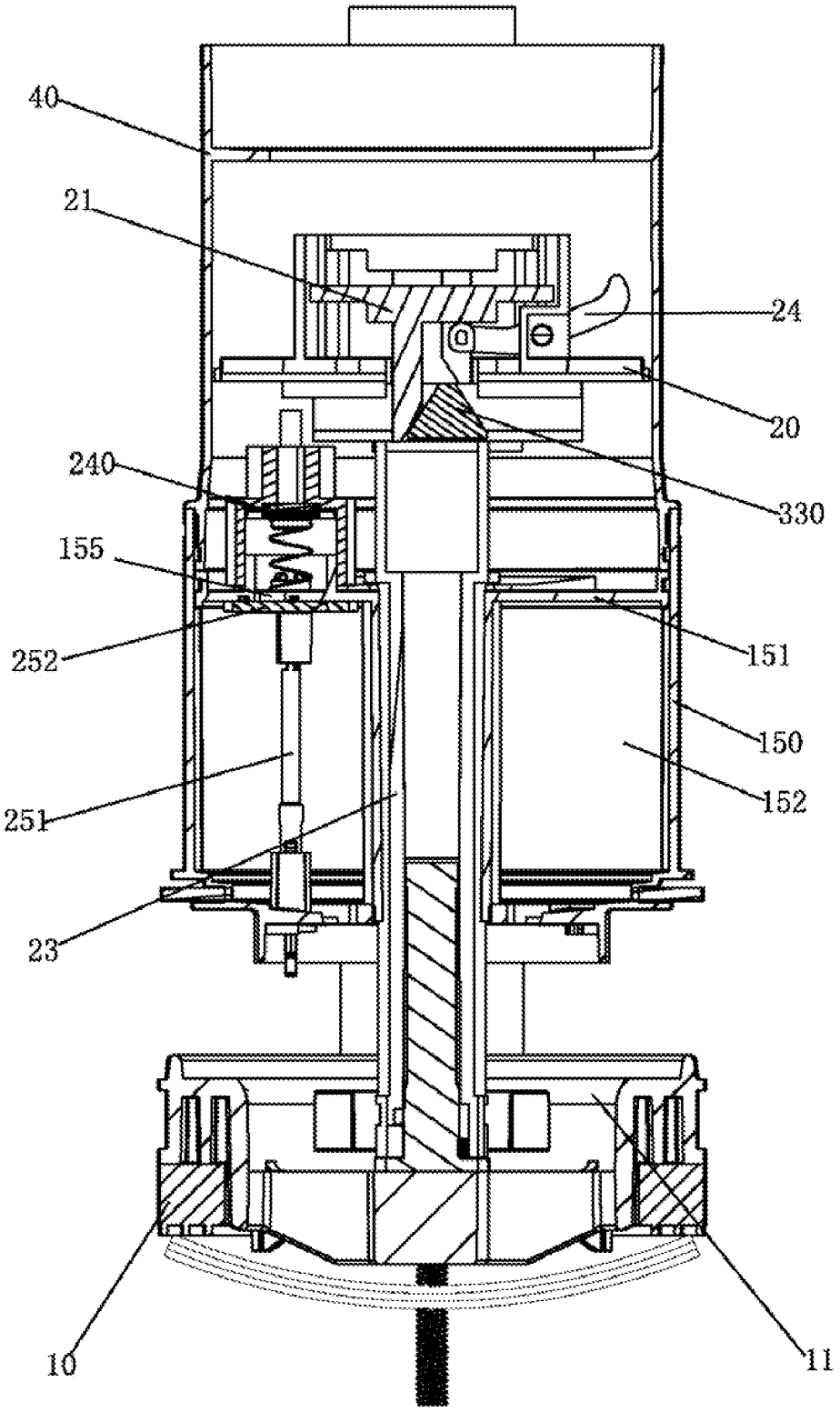
FIG. 15 shows a second sectional schematic view of implementing the first flush of the double-flush light-touch drain valve according to the third embodiment.

As shown in FIG. 14 and FIG. 15, the first key 21 is pressed, the first lifting rod 24 drives the buoy 150 and the controlling part to rise up at the same time; meanwhile, the first key 21 drives the sliding block 330 to slide away from the one-way valve 240, so that the sliding block 330 is staggered from the one-way valve 240, the one-way valve 240 closes the exhaust hole 155, and water enters the buoy cavity 152, while the air in the buoy cavity cannot be exhausted from the exhaust hole 155; therefore, the buoyancy of the buoy 150 is larger, and the buoy drops slowly with the drop of water level; therefore, the first flush implemented at this moment is big-volume flush.

Figure 16:
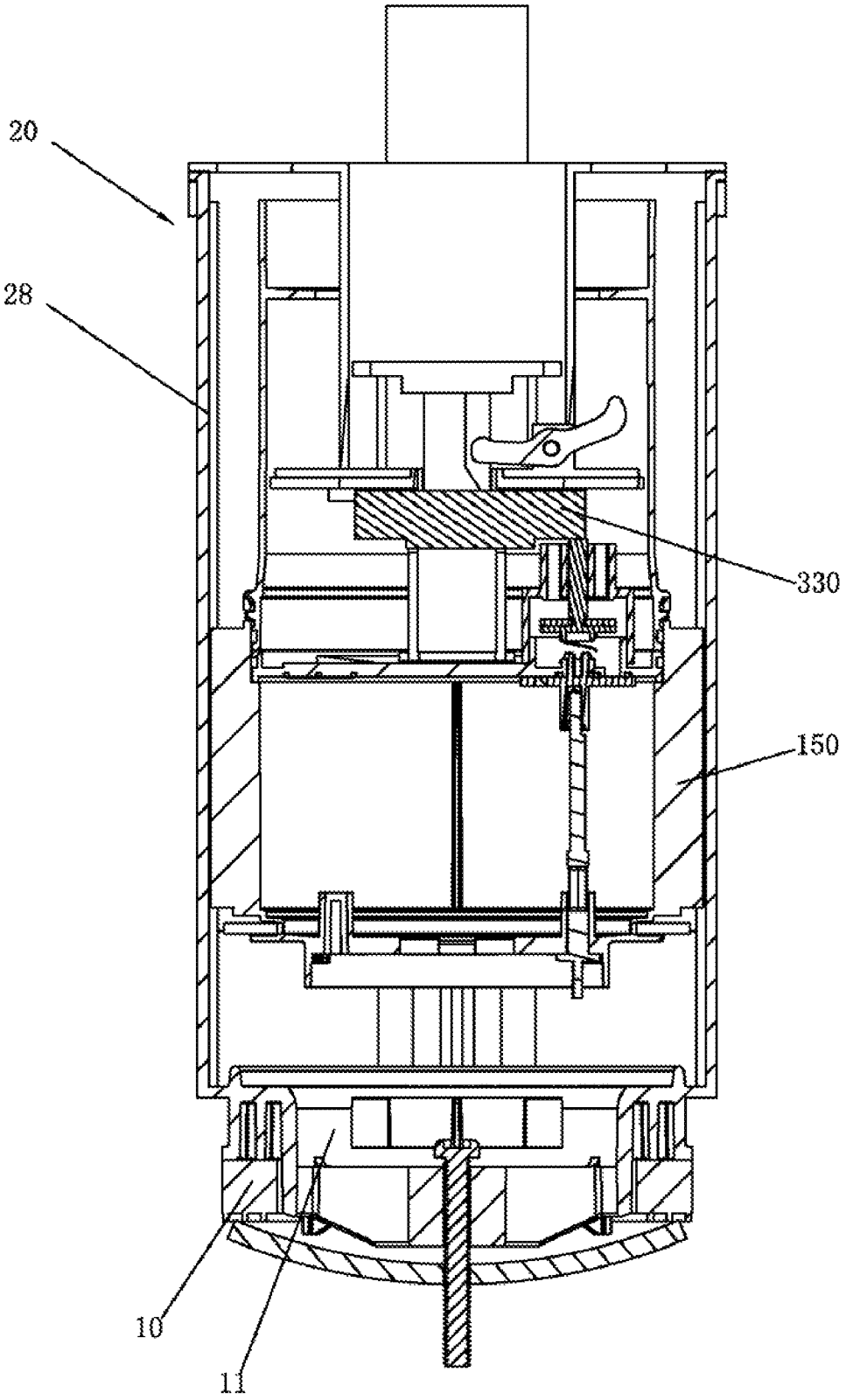
FIG. 16 shows a sectional schematic view of a double-flush light-touch drain valve according to a fourth embodiment.

FIG. 16 shows a fourth embodiment of the double-flush light-touch drain valve. Like reference numerals indicate like elements in FIGS. 1-15.

In the embodiment, the valve body 20 is not provided with a guide rod 23, but is provided with a casing 28, the casing 28 is fixedly installed the base 10, the hollow buoys 150 are sleeved inside the casing 28 and vertically move in a reciprocating manner along the casing 28.

The above descriptions are merely embodiments of the disclosure; therefore, the implementation scope of the disclosure cannot be defined accordingly, i.e., any equivalent change and modification made according to the patent scope and contents of the description of the disclosure shall all fall within the scope covered by the disclosure.

What is claimed is:

1. A double-flush light-touch drain valve, comprising:

a base having a valve body and an outfall;

a buoy component having a flowing channel in communication with an inside and outside of a buoy cavity, the buoy component movably installed on the valve body of the base and capable of moving relatively to the base and opening and closing the outfall; and a starting component having a first starting switch and a second starting switch, wherein the buoy component is in drive connection with the starting component, the first starting switch is operable to drive the buoy component to rise and close the flowing channel so that a resultant force subjected by the buoy component is not influenced by the flowing channel to implement a first flush, and the second starting switch is operable to drive the buoy component to rise and open the flowing channel so that the resultant force subjected by the buoy component is influenced by the flowing channel to implement a second flush.

2. The double-flush light-touch drain valve of claim 1, wherein the starting component further comprises a switching part and a controlling part, the switching part is in drive connection with the first starting switch and the second starting switch, the switching part is in driving fit with the controlling part, the controlling part is fit with the flowing channel, the first starting switch or the second starting switch is operable to drive the controlling part to control the opening and closing of the flowing channel.

3. The double-flush light-touch drain valve of claim 2, wherein the buoy component comprises a buoy and a separating plate installed inside the buoy; the buoy cavity connected with the outfall is formed between the buoy and the separating plate; the separating plate is provided with an exhaust pipe or hole capable of being connected with the buoy cavity and external air, and the exhaust pipe or hole is the flowing channel; when the first starting switch is operated, water enters the buoy cavity while the air in the buoy cavity cannot be exhausted from the exhaust pipe or hole, so that the resultant force subjected by the buoy component is not influenced by the exhaust pipe or hole to implement the first flush; and when the second starting switch is operated, the water enters the buoy cavity to exhaust the air in the buoy cavity out from the exhaust pipe or hole, so that the resultant force subjected by the buoy component is influenced by the exhaust pipe or hole to implement the second flush.

4. The double-flush light-touch drain valve of claim 3, wherein the flowing channel is an exhaust hole, the controlling part is a one-way valve fit with the exhaust hole, the one-way valve closes the exhaust hole when the switching part and the one-way valve are in staggering fit, and the one-way valve opens the exhaust hole when the switching part and the one-way valve are in pressing fit.

5. The double-flush light-touch drain valve of claim 1, wherein the buoy component comprises a buoy and a separating plate installed inside the buoy; the buoy cavity connected with the outfall is formed between the buoy and the separating plate; the separating plate is provided with an exhaust pipe or hole capable of being connected with the buoy cavity and external air, and the exhaust pipe or hole is the flowing channel; when the first starting switch is operated, water enters the buoy cavity and the air in the buoy cavity cannot be exhausted from the exhaust pipe or hole, so that the resultant force subjected by the buoy component is not influenced by the exhaust pipe or hole to implement the first flush; and when the second starting switch is operated, the water enters the buoy cavity to exhaust the air in the buoy cavity out from the exhaust pipe or hole, so that the resultant force subjected by the buoy component is influenced by the exhaust pipe or hole to implement the second flush.

6. The double-flush light-touch drain valve of claim 5, wherein the exhaust pipe is vertically and movably installed on the separating plate to regulate the height of the bottom end of the exhaust pipe in the buoy cavity; or, the exhaust pipe is fixedly installed on the separating plate, and a regulating sleeve is additionally arranged, the regulating sleeve is movably sleeved at the lower portion of the exhaust pipe to regulate the height of the bottom end of the regulating sleeve in the buoy cavity.

7. The double-flush light-touch drain valve of claim 5, further comprising a regulating stem movably installed on the buoy component, wherein the top end of the regulating stem is provided with a regulating portion, and the regulating stem is rotated so that the regulating portion partially or entirely shades the exhaust hole; or, the regulating portion is provided with a second regulating hole, and the regulating stem is rotated so that the second regulating hole is aligned with or staggered from the exhaust hole.

8. The double-flush light-touch drain valve of claim 1, wherein the buoy component comprises a hollow buoy extending along the longitudinal axis, the hollow buoy is sleeved and fit with the valve body, and move in a reciprocating manner along the vertical direction of the valve body.

9. The double-flush light-touch drain valve of claim 8, wherein the valve body is provided with a guide rod, the guide rod is fixedly installed on the base, the hollow buoy is sleeved outside the guide rod and vertically moves in a reciprocating manner along the guide rod.

10. The double-flush light-touch drain valve of claim 1, wherein the starting component further comprises at least one lifting rod, the lifting rod is movably installed on the valve body and in drive connection with the buoy component, and the first starting switch or the second starting switch is operable to make the lifting rod rock to lift the buoy component for water drainage.

11. A double-flush control method for a double-flush light-touch drain valve, comprising:

when a first starting switch is operated, implementing a first flush by using a starting component to drive a buoy component to raise, leaving an outfall of a base for water drainage, and simultaneously closing a flowing channel on the buoy component so that a resultant force subjected by the buoy component is not influenced by the flowing channel; and when a second starting switch is operated, implementing a second flush by using the starting component to drive the buoy component to raise, leaving the outfall of the base for water drainage, and simultaneously opening the flowing channel on the buoy component so that the resultant force subjected by the buoy component is influenced by the flowing channel.

* * * * *